US010676336B2

(12) United States Patent
Makino et al.

(10) Patent No.: US 10,676,336 B2
(45) Date of Patent: Jun. 9, 2020

(54) BEVERAGE SUPPLYING DEVICE

(71) Applicant: Panasonic Intellectual Property Management Co., Ltd., Osaka (JP)

(72) Inventors: Atsushi Makino, Saitama (JP); Akira Goitsuka, Saitama (JP); Fumihiro Takahashi, Tochigi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 16/456,251

(22) Filed: Jun. 28, 2019

(65) Prior Publication Data

US 2019/0315613 A1 Oct. 17, 2019

Related U.S. Application Data

(63) Continuation of application No. 15/522,051, filed as application No. PCT/JP2015/005396 on Oct. 27, 2015, now Pat. No. 10,377,620.

(30) Foreign Application Priority Data

Oct. 31, 2014 (JP) ..... 2014-223608

(51) Int. Cl.
*B67D 1/00* (2006.01)
*B67D 1/12* (2006.01)
(Continued)

(52) U.S. Cl.
CPC ..... *B67D 1/0028* (2013.01); *B67D 1/004* (2013.01); *B67D 1/0031* (2013.01);
(Continued)

(58) Field of Classification Search
CPC .... B67D 1/0015; B67D 1/0021; B67D 1/004; B67D 2001/0097; B67D 1/04; B67D 1/0888; B67D 1/0882; B67D 1/0894
See application file for complete search history.

(56) References Cited

U.S. PATENT DOCUMENTS 2,757,839 A 8/1956 Carew
3,584,764 A 6/1971 Elkins
(Continued)

FOREIGN PATENT DOCUMENTS

JP H07-165294 A 6/1995
JP 2001-213499 A 8/2001
(Continued)

OTHER PUBLICATIONS

International Search Report and Written Opinion issued in International Patent Application No. PCT/JP2015/005396, dated Jan. 19, 2016; with partial English translation.

*Primary Examiner* — Patrick M. Buechner
(74) *Attorney, Agent, or Firm* — McDermott Will & Emery LLP

(57) ABSTRACT

A beverage supplying device comprising: a touch panel for receiving an operation for selecting a main syrup constituting a main beverage, and a topping syrup added as flavoring to the main beverage; a second syrup solenoid valve for opening and closing a passage for supplying the topping syrup that is stored under pressure in a syrup tank; a second syrup pump for intermittently supplying the topping syrup while the second syrup solenoid valve is open, the second syrup pump being provided to the passage for supplying the topping syrup between the syrup tank and the second syrup solenoid valve; and a nozzle for producing the main beverage by mixing the main syrup with water or carbonated water at a prescribed ratio, and producing a beverage by mixing the topping syrup with the main beverage without diluting the topping syrup.

6 Claims, 9 Drawing Sheets

(51) Int. Cl.
*G07F 13/06* (2006.01)
*B67D 1/08* (2006.01)
*B67D 1/10* (2006.01)

(52) U.S. Cl.
CPC ..... *B67D 1/0036* (2013.01); *B67D 1/0037* (2013.01); *B67D 1/0039* (2013.01); *B67D 1/0046* (2013.01); *B67D 1/0888* (2013.01); *B67D 1/10* (2013.01); *B67D 1/12* (2013.01); *B67D 1/1215* (2013.01); *B67D 1/1218* (2013.01); *G07F 13/06* (2013.01); *B67D 1/0057* (2013.01); *B67D 2001/0092* (2013.01); *B67D 2001/0097* (2013.01); *B67D 2001/0098* (2013.01); *B67D 2001/1259* (2013.01); *B67D 2210/00123* (2013.01)

(56) References Cited

U.S. PATENT DOCUMENTS 4,487,333 A 12/1984 Sounder et al.
4,753,370 A * 6/1988 Rudick ..... B67D 1/0051 222/105
5,000,351 A * 3/1991 Rudick ..... B67D 1/0036 222/105
5,191,999 A 3/1993 Cleland
5,316,180 A 5/1994 Cleland
5,381,926 A * 1/1995 Credle, Jr. ..... B67D 1/0032 222/1
5,738,248 A * 4/1998 Green ..... B67D 1/0031 222/129.2
5,803,320 A 9/1998 Cutting et al.
9,511,987 B2 * 12/2016 Hayakawa ..... B67D 1/0037
2001/0048958 A1 12/2001 Funk
2002/0060226 A1 5/2002 Kameyama
2002/0074348 A1 6/2002 Eyes
2002/0083842 A1 * 7/2002 Kown ..... C02F 1/46104 99/290
2006/0168986 A1 8/2006 Saitoh et al.
2007/0145074 A1 * 6/2007 Sevcik ..... B67D 1/06 222/129.1
2007/0205221 A1 9/2007 Carpenter et al.
2008/0189078 A1 8/2008 Vok et al.
2009/0069932 A1 3/2009 Rudick
2009/0069933 A1 * 3/2009 Rudick ..... B67D 1/0034 700/239
2009/0095771 A1 * 4/2009 Hoover ..... B67D 1/0022 222/129.1
2010/0125362 A1 * 5/2010 Canora ..... G06Q 20/3278 700/236
2011/0049180 A1 3/2011 Carpenter et al.
2012/0325845 A1 * 12/2012 Newman ..... B67D 1/0022 222/1
2013/0106690 A1 * 5/2013 Lim ..... G07F 13/065 345/156
2014/0107835 A1 * 4/2014 Biasi ..... B67D 1/0036 700/231
2014/0263413 A1 * 9/2014 Green ..... B67D 1/0888 222/1
2014/0263416 A1 * 9/2014 Green ..... B67D 1/0021 222/1
2015/0046877 A1 * 2/2015 Cuppari ..... B67D 1/0015 715/834
2015/0210522 A1 7/2015 Jersey et al.
2015/0251891 A1 * 9/2015 Peters ..... B67D 1/0041 222/129.1
2016/0023883 A1 1/2016 Jersey
2017/0305735 A1 10/2017 Kuboi et al.

FOREIGN PATENT DOCUMENTS

JP 2002-179194 A 6/2002
JP 3947914 B2 7/2007
JP 2013-189251 A 9/2013

* cited by examiner

BEVERAGE SUPPLYING DEVICE

RELATED APPLICATIONS

This application is a continuation of U.S. patent application Ser. No. 15/522,051, filed Apr. 26, 2017, which is the U.S. National Phase under 35 U.S.C. § 371 of International Patent Application No. PCT/JP2015/005396, filed on Oct. 27, 2015, which in turn claims the benefit of Japanese Application No. 2014-223608, filed on Oct. 31, 2014, the disclosures of which Applications are incorporated by reference herein.

TECHNICAL FIELD

The present invention relates to a beverage supplying apparatus that supplies a beverage.

BACKGROUND ART

Conventionally, beverage supplying apparatuses are known which produce a beverage by mixing a syrup with diluted water and supply the produced beverage. Such beverage supplying apparatuses can normally produce and supply a plurality of kinds of beverages.

More specifically, a beverage supplying apparatus is provided with a button for receiving an operation for selecting a beverage to be produced, and discharges, when the button is pressed, a syrup necessary to produce the beverage from among different kinds of syrups respectively stored in a plurality of syrup tanks. At the same time, the beverage supplying apparatus discharges diluted water and produces beverage by mixing the syrup with the diluted water.

As an example of such a beverage supplying apparatus, Patent Literature (hereinafter referred to as "PTL") 1 discloses a technique of applying a gas pressure to a syrup stored in a syrup tank, intermittently opening/closing a solenoid valve provided in a passage for supplying the syrup to thereby discharge the syrup and diluting the discharged syrup with water.

CITATION LIST

Patent Literature

PTL 1
Japanese Patent Publication No. 3947914

SUMMARY OF INVENTION

Technical Problem

However, the above technique of PTL 1 has a problem that the number of beverage flavor choices is limited. This is because the number of kinds of syrups used to produce a beverage is limited to one. Two kinds of syrups may be mixed to increase the number of beverage flavor choices, but the technique disclosed in PTL 1 is not intended to mix two kinds of syrups in the first place, and does not disclose how such mixing should be carried out at all.

For example, by simply mixing two kinds of syrups, it is difficult to produce a beverage with two kinds of syrup flavors tasted well balanced. For this reason, development of a technique has been expected which can easily produce a beverage with two kinds of syrup flavors tasted well balanced.

It is an object of the present invention to provide a beverage supplying apparatus capable of effectively increasing the number of beverage flavor choices and appropriately adjusting beverage flavor even when syrups with a plurality of flavors are mixed.

Solution to Problem

A beverage supplying apparatus according to the present invention is an apparatus that supplies a plurality of types of beverages, the apparatus including: an operation receiving section that receives an operation for selecting a first syrup diluted with water or carbonated water to constitute a main beverage from among different types of syrups stored in a plurality of syrup tanks and an operation for selecting a second syrup to be added to the main beverage as a flavor, from among the different types of syrups; a valve that opens/closes a passage for supplying the second syrup stored under pressure in one of the plurality of syrup tanks; a pump that is provided in the passage for supplying the second syrup between the syrup tank storing the second syrup and the valve and that intermittently supplies the second syrup when the valve is open; and a mixing section that produces the main beverage by mixing the water or carbonated water and the first syrup at a prescribed ratio and that produces a beverage by mixing the second syrup with the main beverage without diluting the second syrup.

A beverage supplying apparatus according to the present invention is an apparatus that supplies a plurality of types of beverages, the apparatus including: an operation receiving section that receives an operation for selecting a first syrup diluted with water or carbonated water to constitute a main beverage from among different types of syrups stored in a plurality of syrup tanks and an operation for selecting a second syrup to be added to the main beverage as a flavor, from among the different types of syrups; a first valve that opens/closes a passage for supplying the first syrup stored under pressure in one of the plurality of syrup tanks; a second valve that opens/closes a passage for supplying the second syrup stored under pressure in one of the plurality of syrup tanks and that is opened in every N (N is an integer equal to or greater than 1) time zones among a plurality of time zones in which the first valve is opened; and a mixing section that produces the main beverage by mixing the water or carbonated water with the first syrup supplied via the first valve, at a prescribed ratio and that produces a beverage by mixing, with the main beverage, the second syrup supplied via the second valve without diluting the second syrup.

Advantageous Effects of Invention

According to the present invention, it is possible to effectively increase the number of beverage flavor choices and appropriately adjust beverage flavor even when syrups with a plurality of flavors are mixed.

DESCRIPTION OF EMBODIMENTS

Hereinafter, an embodiment of the present invention will be described with reference to the accompanying drawings.

Figure 1:
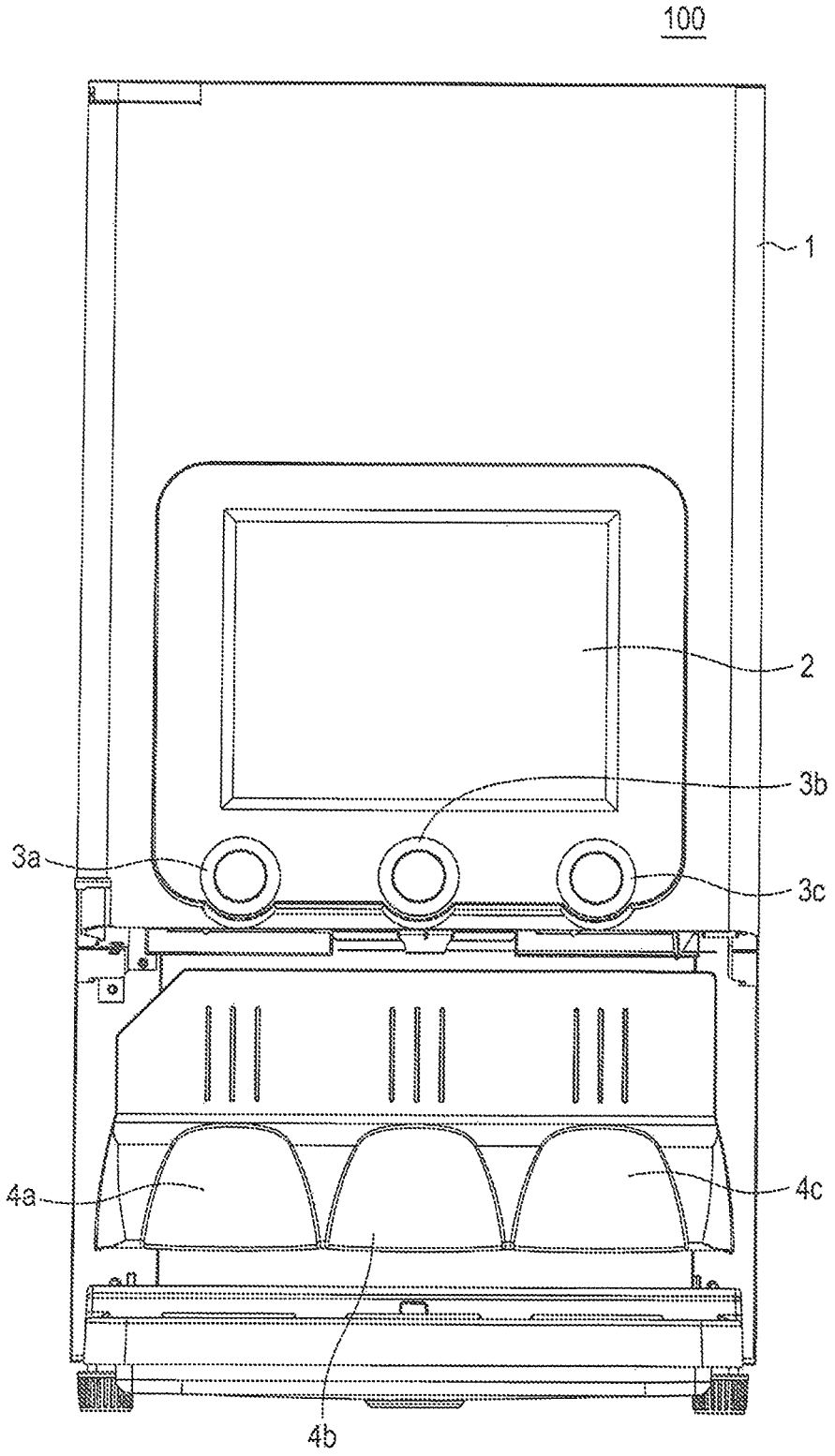
FIG. 1 is a front view of a beverage supplying apparatus according to an embodiment of the present invention.
Figure 2:
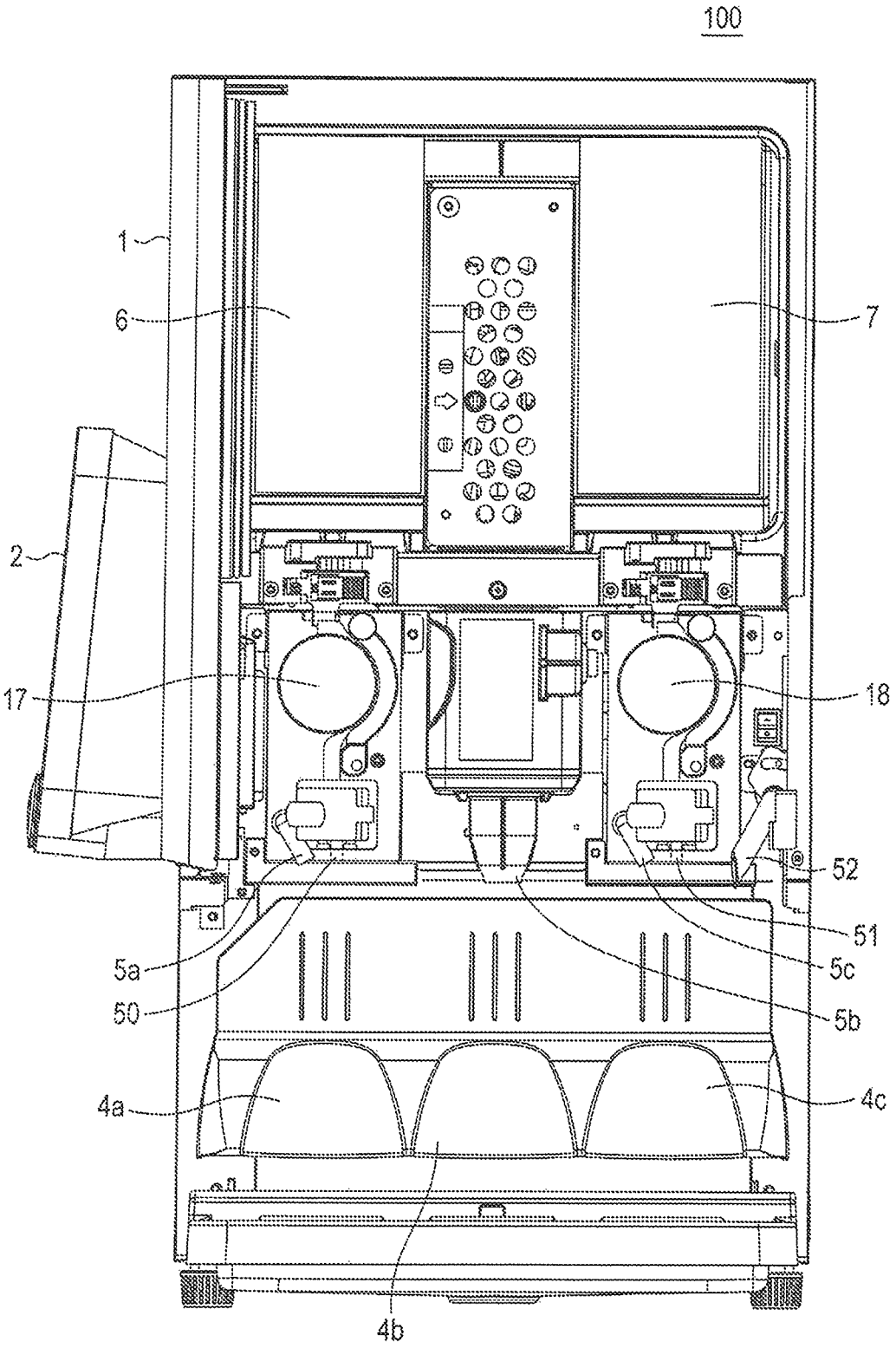
FIG. 2 is a front view of the beverage supplying apparatus according to the embodiment of the present invention, illustrating an interior thereof when a front door is opened.
Figure 3:
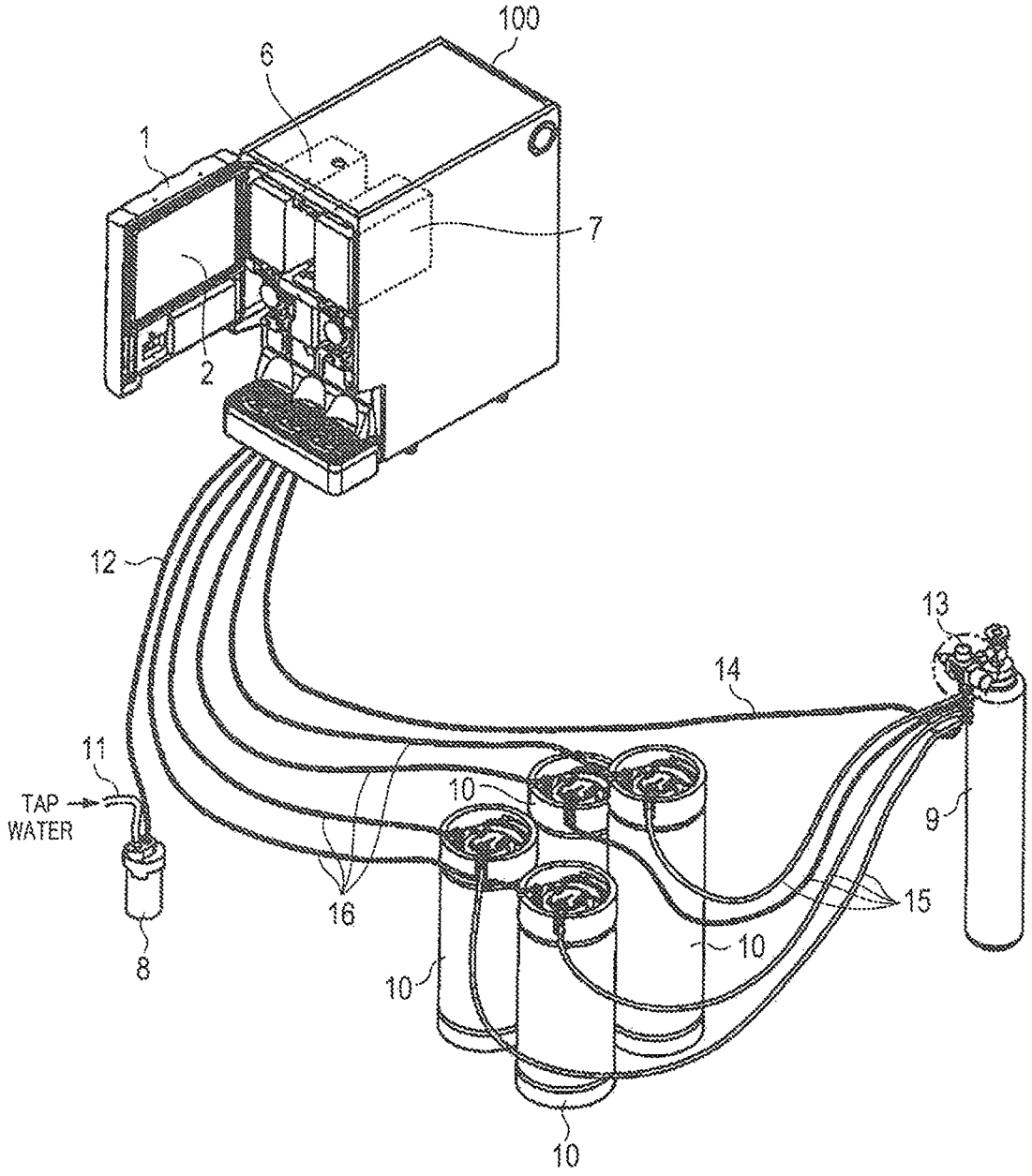
FIG. 3 is a diagram illustrating an external configuration of the beverage supplying apparatus according to the embodiment of the present invention.

First, a configuration example of beverage supplying apparatus 100 according to an embodiment of the present invention will be described using FIG. 1 to FIG. 3. FIG. 1 is a front view of beverage supplying apparatus 100 according to an embodiment of the present invention. FIG. 2 is a front view of beverage supplying apparatus 100 according to the embodiment of the present invention, illustrating an interior thereof when a front door is opened. FIG. 3 is a diagram illustrating an external configuration of beverage supplying apparatus 100 according to the embodiment of the present invention.

As shown in FIG. 1, beverage supplying apparatus 100 is provided with touch panel 2 on front door 1 that can be opened/closed. Touch panel 2 is an operation receiving section that displays beverage choices for a user of beverage supplying apparatus 100 and receives an operation for selecting a beverage by the user.

More specifically, touch panel 2 displays choices for a main syrup constituting a main beverage and diluted with carbonated water and choices for a topping syrup added to the main beverage as a flavor, and receives an operation for selecting the main syrup and the topping syrup from the user.

As shown in FIG. 1, physical buttons 3*a* to 3*c* are provided at lower parts of touch panel 2. Physical buttons 3*a* to 3*c* receive an operation for instructing discharge of a beverage from the user. Container placement areas 4*a* to 4*c* for the user to place a container (glass, cup, or the like) are provided below physical buttons 3*a* to 3*c*.

Physical button 3*a* corresponds to container placement area 4*a*, and also corresponds to diluted water nozzle 5*a* and syrup nozzle 50 shown in FIG. 2. Furthermore, physical button 3*b* corresponds to container placement area 4*b*, and also corresponds to nozzle 5*b* shown in FIG. 2. Physical button 3*c* corresponds to container placement area 4*c*, and also corresponds to diluted water nozzle 5*c*, syrup nozzle 5 and carbonated water nozzle 52 shown in FIG. 2.

The user performs an operation for selecting a beverage on touch panel 2, then places a container at one of container placement areas 4*a* to 4*c* and presses one of physical buttons 3*a* to 3*c*.

When, for example, physical button 3*a* is pressed, a syrup in bag-in-box (hereinafter referred to as "BIB") 6 shown in FIG. 2 is discharged from syrup nozzle 50 by a function of BIB tube pump 17 and becomes a discharge flow. This syrup discharge flow collides and is mixed with a discharge flow of diluted water (tap water) discharged from diluted water nozzle 5*a*. A beverage is thus produced. The beverage produced in this way is supplied to a container placed at container placement area 4*a*.

When, for example, physical button 3*b* is pressed, a syrup is mixed with diluted water and/or carbonated water at nozzle 5*b* and a beverage is thus produced. The beverage produced in this way is discharged from nozzle 5*b* and supplied to a container placed at container placement area 4*b*.

When, for example, physical button 3*c* is pressed, a syrup in BIB 7 shown in FIG. 2 is discharged from syrup nozzle 51 by a function of BIB tube pump 18 and becomes a discharge flow. This syrup discharge flow collides and is mixed with a discharge flow of diluted water discharged from diluted water nozzle 5*c* and/or a discharge flow of carbonated water discharged from carbonated water nozzle 52. A beverage is thus produced. The beverage produced in this way is supplied to a container placed at container placement area 4*c*.

Note that each aforementioned beverage is supplied to each container while physical button 3*a* to 3*c* is being pressed.

Driving of aforementioned BIB tube pumps 17 and 18 are controlled by control section 20 (see FIG. 4) which will be described later. Control section 20 reads setting data for controlling the driving of BIB tube pumps 17 and 18 from storage section 21 (see FIG. 4) which will be described later and controls the driving of BIB tube pumps 17 and 18 based on the setting data. Syrups are thereby delivered from BIBs 6 and 7.

Aforementioned carbonated water nozzle 52 may be provided on a BIB 6 side or may be provided on both BIB 6 and BIB 7 sides.

Aforementioned BIBs 6 and 7 are provided in a refrigerating area. BIBs 6 and 7 store syrups requiring cool storage. Syrups not requiring cool storage are stored in syrup tank 10 which will be described later using FIG. 3.

Syrups referred to here in the present embodiment are assumed to include not only condensed liquid containing sugar but also condensed liquid not containing sugar (e.g., stock solution of green tea or tea).

Aforementioned nozzle 5*b* is a mixing section that produces a main beverage by mixing water or carbonated water with a main syrup at a prescribed ratio and produces a beverage by mixing an undiluted topping syrup with the main beverage (hereinafter referred to as "flavor-added beverage"). The flavor-added beverage produced at nozzle 5*b* is discharged from nozzle 5*b* into a container placed in container placement area 4*b*.

Mixing two kinds of syrups, that is, main syrup and topping syrup, can drastically increase the number of beverage flavor choices to be provided to the user.

Here, the main syrup and the topping syrup are stored in syrup tanks 10 shown in FIG. 3 which will be described below. Note that nozzle 5*b* also discharges, in addition to the above flavor-added beverage, water only or carbonated water only.

Furthermore, as shown in FIG. 3, beverage supplying apparatus 100 is provided with cleaning filter 8, carbon dioxide gas cylinder 9 and a plurality of syrup tanks 10.

Cleaning filter 8 cleans tap water supplied from blade tube 11 and supplies the cleaned water into beverage supplying apparatus 100 via blade tube 12. Blade tube 12 is connected, for example, to diluted water inlet solenoid valve 31 (see FIG. 4 and FIG. 8 which will be described later) provided inside beverage supplying apparatus 100. The cleaned water supplied into beverage supplying apparatus 100 is supplied to the user as beverage as is or used as diluted water or pressurized water.

Carbon dioxide gas cylinder 9 stores a carbon dioxide gas. This carbon dioxide gas is supplied to carbonator 23 via blade tube 14 at a prescribed pressure (e.g., 0.6 MPa) set in gas regulator 13. This carbon dioxide gas is further supplied to each syrup tank 10 via blade tube 15 at a prescribed pressure (e.g., 0.2 MPa) set in gas regulator 13.

A plurality of syrup tanks 10 store different syrups. As described above, these syrups are used as a main syrup or topping syrup. These syrups are pushed out under a pressure of the gas supplied from carbon dioxide gas cylinder 9 and supplied to nozzle 5*b* via blade tube 16.

Figure 4:
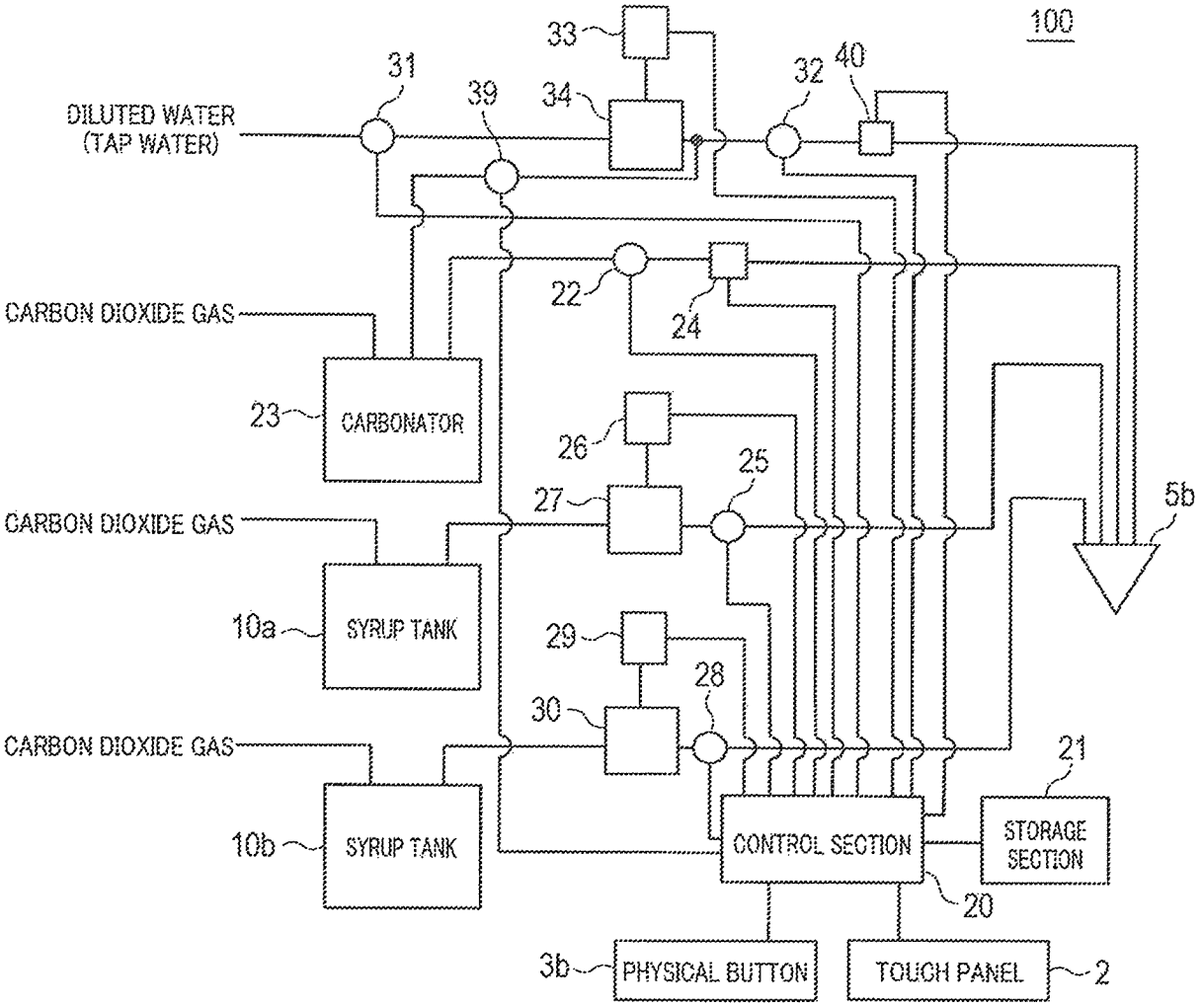
FIG. 4 is a diagram illustrating a piping system of the beverage supplying apparatus according to the embodiment of the present invention.
Figure 5:
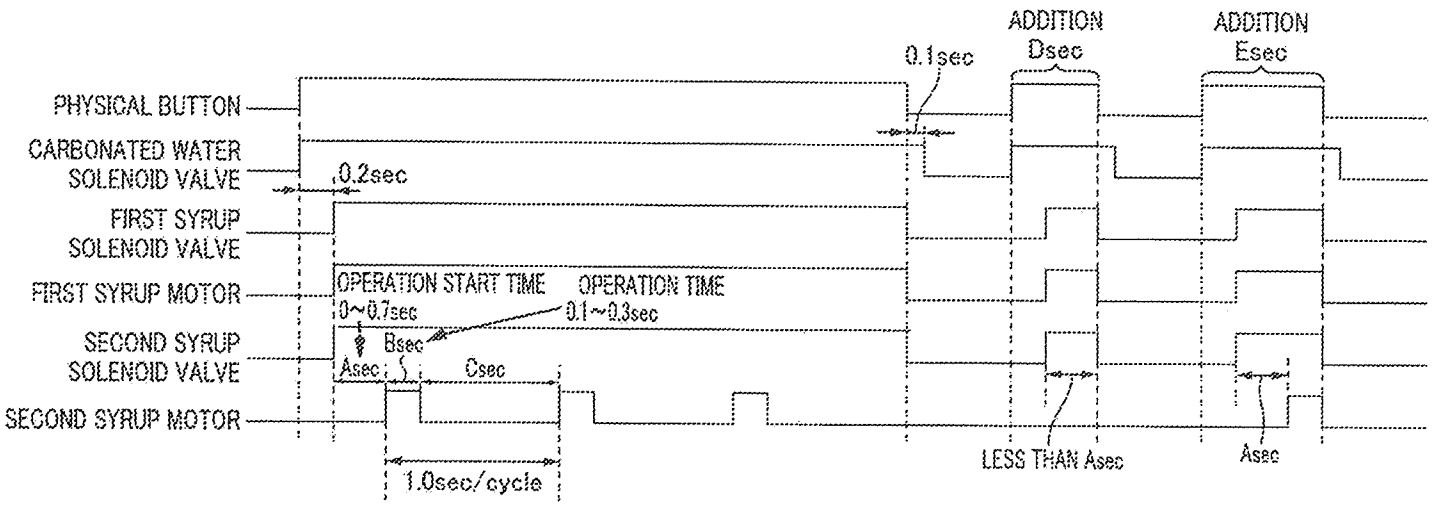
FIG. 5 is a time chart of the beverage supplying apparatus according to the embodiment of the present invention when a strong carbonated beverage is supplied.

Next, beverage supply control processing by beverage supplying apparatus 100 of the present embodiment will be described using FIG. 4 and FIG. 5. FIG. 4 is a diagram illustrating a piping system of beverage supplying apparatus 100 according to the embodiment of the present invention. FIG. 5 is a time chart of beverage supplying apparatus 100 according to the embodiment of the present invention when a beverage is supplied.

(Method of Supplying Strong Carbonated, Flavor-Added Beverage)

First, an example of control operation when a strong carbonated, flavor-added beverage is supplied will be described.

Here, the "strong carbonated, flavor-added beverage" is a beverage in which a main syrup, carbonated water and topping syrup are mixed together.

As shown in FIG. 4, in addition to aforementioned touch panel 2, physical button 3*b* and nozzle 5*b*, beverage supplying apparatus 100 is provided with syrup tanks 10*a* and 10*b*, control section 20, storage section 21, carbonated water solenoid valve 22, carbonator 23, flowmeters 24 and 40, first syrup solenoid valve 25, first syrup motor 26, first syrup pump 27, second syrup solenoid valve 28, second syrup motor 29, second syrup pump 30, diluted water inlet solenoid valve 31, diluted water solenoid valve 32, diluted water pump motor 33, diluted water pump 34, and pressurized water solenoid valve 39.

Syrup tank 10*a* and syrup tank 10*b* are each one of syrup tanks 10 in FIG. 3 and store a syrup used as a main syrup or topping syrup (e.g., cola syrup, orange syrup).

Control section 20 is a control device such as a CPU (central processing unit). Storage section 21 is a memory device such as a ROM (read only memory) or RAM (random access memory).

When the user performs an operation for selecting a strong carbonated, flavor-added beverage on touch panel 2, control section 20 reads data relating to the selected beverage from storage section 21.

Examples of such data include data on a dilution ratio among a main syrup, carbonated water and topping syrup registered in association with combinations of main syrup and topping syrup, setting data for controlling opening/closing of each solenoid valve (carbonated water solenoid valve 22, first syrup solenoid valve 25, second syrup solenoid valve 28, diluted water inlet solenoid valve 31, diluted water solenoid valve 32, pressurized water solenoid valve 39) in accordance with the dilution ratio and setting data for controlling driving of each motor (first syrup motor 26, second syrup motor 29) in accordance with the dilution ratio.

When the user presses physical button 3*b*, control section 20 performs the following control based on each of the above pieces of data.

As shown in FIG. 5, when physical button 3*b* is pressed, control section 20 opens carbonated water solenoid valve 22 first. This causes carbonated water produced in carbonator 23 to be sent to nozzle 5*b* via carbonated water solenoid valve 22 and flowmeter 24, which are open.

Note that the amount of carbonated water produced in carbonator 23 is managed by a level switch provided in carbonator 23. When the amount of carbonated water stored in carbonator 23 falls to or below a prescribed amount, the level switch is turned on. When the level switch is turned on, control section 20 performs the following control to produce carbonated water.

That is, control section 20 opens diluted water inlet solenoid valve 31 and pressurized water solenoid valve 39 to drive diluted water pump motor 33. At this time, diluted water solenoid valve 32 is controlled so as to be closed. Diluted water pump 34 is thereby driven and pressurized diluted water (pressurized tap water) is supplied to carbonator 23 via diluted water inlet solenoid valve 31 and pressurized water solenoid valve 39.

The diluted water supplied to carbonator 23 is mixed with a carbon dioxide gas and becomes carbonated water. After that, when the amount of carbonated water produced reaches a prescribed amount, the level switch is turned off. When the level switch is turned off, control section 20 stops the above control. Production of carbonated water is thereby stopped.

Here, flowmeter 24 generates a pulse every time a unit amount of carbonated water passes. Control section 20 performs, for example, the following control based on this pulse.

Control section 20 counts the pulse of flowmeter 24 and thereby detects a flow rate of carbonated water sent from nozzle 5*b* while physical button 3*b* is being pressed.

Furthermore, control section 20 counts the pulse of flowmeter 24, controls the number of revolutions of first syrup motor 26 based on the pulse and thereby controls the flow rate of the first syrup sent from nozzle 5*b* while physical button 3*b* is being pressed.

Furthermore, control section 20 counts the pulse of flowmeter 24, controls the number of revolutions of second syrup motor 29 based on the pulse and thereby controls the flow rate of the second syrup sent from nozzle 5*b* while physical button 3*b* is being pressed.

Furthermore, control section 20 is provided with a timer that is activated simultaneously with pressing of physical button 3*b* and measures an elapsed time from the time of pressing. Control section 20 performs, for example, the following various types of control based on the elapsed time measured by the timer.

As shown in FIG. 5, after a prescribed time (e.g., 0.2 seconds) passes from the opening of carbonated water solenoid valve 22, control section 20 controls first syrup solenoid valve 25 and second syrup solenoid valve 28 to open first syrup solenoid valve 25 and second syrup solenoid valve 28.

Simultaneously, control section 20 controls first syrup motor 26 as shown in FIG. 5 to start driving first syrup motor 26. The driving of first syrup motor 26 causes first syrup pump 27 to send a main syrup supplied from syrup tank 10*a* to nozzle 5*b* via first syrup solenoid valve 25 which is open. First syrup pump 27 is, for example, a gear pump.

After prescribed time A (e.g., 0 to 0.7 seconds) passes from the start of driving of first syrup motor 26 (start of opening of first syrup solenoid valve 25 or second syrup solenoid valve 28), control section 20 controls second syrup motor 29 to start driving second syrup motor 29.

At this time, control section 20 intermittently drives second syrup motor 29. For example, as shown in FIG. 5, second syrup motor 29 repeats a cycle of driving for prescribed time B (e.g., 0.1 to 0.3 seconds) and stopping for prescribed time C (0.7 to 0.9 seconds).

Driven by second syrup motor 29, second syrup pump 30 sends a small amount of undiluted topping syrup supplied from syrup tank 10*b* to nozzle 5*b* via second syrup solenoid valve 28 which is open. Second syrup pump 30 is, for example, a gear pump.

In this way, while physical button 3*b* is being pressed, the aforementioned carbonated water, main syrup and topping syrup are mixed together at nozzle 5*b* and discharged into a container placed in container placement areas 4*b* as a strong carbonated, flavor-added beverage.

Note that as described above, beverage supplying apparatus 100 produces a main beverage by mixing carbonated water and a main syrup at a prescribed ratio, and also produces a beverage by mixing an undiluted topping syrup with the main beverage, and control section 20 changes the above prescribed ratio when mixing carbonated water and the main syrup in accordance with a combination of the main syrup and the topping syrup.

It is thereby possible to keep the sugar content or the like of the beverage produced within a predetermined range irrespective of the combination of the main syrup and the topping syrup.

Note that the flow rate of carbonated water may also be detected from an opening time (time period during which the valve is open) of carbonated water solenoid valve 22 instead of flowmeter 24. Furthermore, the flow rates of the first syrup and the second syrup may also be detected from a flowmeter which is not shown (e.g., flowmeter provided downstream of first syrup solenoid valve 25 or downstream of second syrup solenoid valve 28).

A configuration may also be adopted in which control section 20 not only generates a pulse every time a unit amount of carbonated water passes through flowmeter 24 but also counts this pulse and measures the time, and thereby controls first syrup motor 26, second syrup motor 29, carbonated water solenoid valve 22, first syrup solenoid valve 25, second syrup solenoid valve 28 or the like based on the time.

Since the topping syrup is added as a flavor, an adding amount thereof may be very small and an excessive adding amount may upset the flavor balance between the main syrup and the topping syrup. Therefore, a prescribed amount of topping syrup needs to be added precisely.

An attempt to add such a small amount of topping syrup for a long period of time as in the case of the discharge control of the main syrup shown in FIG. 5 may make it difficult to control the discharge amount of the topping syrup.

Therefore, the topping syrup is intermittently added without diluting it in the present embodiment. It is thereby possible to precisely add a prescribed amount of topping syrup and prevent loss of flavor balance. As a result, the beverage manufacturer can provide a beverage with an intended flavor to users.

As described above, if the topping syrup is sent using second syrup pump 30, it is possible to precisely add a prescribed amount of topping syrup no matter how small the amount may be.

After that, when a strong carbonated, flavor-added beverage is discharged into the container and the pressing of physical button 3*b* ends, control section 20 closes first syrup solenoid valve 25 and second syrup solenoid valve 28 as shown in FIG. 5.

Simultaneously, control section 20 stops driving of first syrup motor 26 and second syrup motor 29. Discharging of the beverage from nozzle 5*b* is thus stopped.

After a prescribed time (e.g., 0.1 seconds) passes from the end of pressing of physical button 3*b*, control section 20 closes carbonated water solenoid valve 22. The reason that carbonated water solenoid valve 22 is not closed immediately after the pressing of physical button 3*b* ends is to clean nozzle 5*b* with carbonated water.

As described above, according to beverage supplying apparatus 100 of the present embodiment, the topping syrup is discharged intermittently without diluting it using the syrup pump, and it is thereby possible to control the amount of topping syrup discharged with high accuracy and produce a beverage with an intended flavor.

Next, a case will be described using FIG. 5 where after the beverage is supplied, an operation for adding a beverage is performed. FIG. 5 shows a case where as an addition operation, physical button 3*b* is pressed for time D and then physical button 3*b* is further pressed for time E.

As shown in FIG. 5, for time D from start to end of pressing of physical button 3*b*, when an elapsed time after driving of first syrup motor 26 is started (or after opening of first syrup solenoid valve 25 or second syrup solenoid valve 28 is started) is less than prescribed time A (e.g., 0 to 0.7 seconds), control section 20 does not drive second syrup motor 29. In this case, no topping syrup is added to the addition target beverage.

On the other hand, for time E from start to end of pressing of physical button 3*b*, when an elapsed time after driving of first syrup motor 26 is started (or after opening of first syrup solenoid valve 25 or second syrup solenoid valve 28 is started) is equal to or greater than prescribed time A (e.g., 0 to 0.7 seconds), control section 20 drives second syrup motor 29. In this case, the topping syrup is added to the addition target beverage.

When the addition operation is performed under such control, the topping syrup can be easily added.

Note that when the addition operation is repeatedly performed, for which the elapsed time after driving of first syrup motor 26 is started is less than above prescribed time A, the ratio of the topping syrup to the beverage decreases. For this reason, control section 20 may perform the following control.

More specifically, when physical button 3*b* is pressed a plurality of times, if the total elapsed time after driving of first syrup motor 26 each time is started (or opening of first syrup solenoid valve 25 or second syrup solenoid valve 28 is started) is equal to or greater than prescribed time A (e.g., 0 to 0.7 seconds), control section 20 may drive second syrup motor 29.

Thus, even when an addition operation is repeatedly performed, for which the elapsed time after driving of first syrup motor 26 is started is less than above prescribed time A, the topping syrup is added and a beverage with a more optimum flavor can be supplied to the user.

(Method of Supplying Carbonate-Free, Flavor-Added Beverage)

Next, an example of control operation when a carbonate-free, flavor-added beverage is supplied will be described. Even when a carbonate-free, flavor-added beverage is supplied, control section 20 can control each solenoid valve 22, 25, 28, 31 or 32 and each motor 26, 29 or 33 as in the case of control operation when the aforementioned strong carbonated, flavor-added beverage is supplied.

Here, the carbonate-free, flavor-added beverage is a beverage in which the main syrup, diluted water (tap water) and topping syrup are mixed together.

Figure 6A:
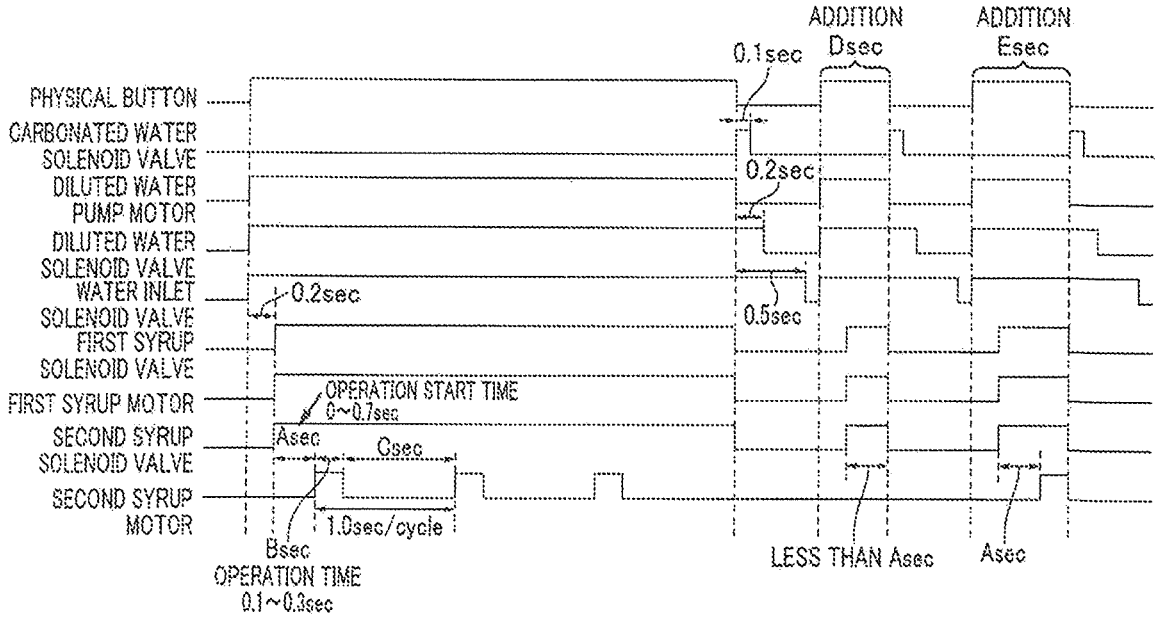
FIG. 6A is a time chart of the beverage supplying apparatus according to the embodiment of the present invention when a carbonate-free, flavor-added beverage is supplied.

FIG. 6A is a time chart when a carbonate-free, flavor-added beverage is supplied. In the case of FIG. 6A, even when physical button 3*b* is pressed, carbonated water solenoid valve 22 is not opened, but diluted water inlet solenoid valve 31 provided at an inlet of a passage for supplying water to beverage supplying apparatus 100 is opened instead.

Furthermore, diluted water solenoid valve 32 is opened and diluted water pump motor 33 is driven. Thus, diluted water pump 34 is driven and diluted water is supplied to nozzle 5*b* via diluted water solenoid valve 32 and flowmeter 40 provided downstream of diluted water solenoid valve 32.

Here, flowmeter 40 generates a pulse every time a unit amount of diluted water passes. Control section 20 performs, for example, the following control based on this pulse.

Control section 20 counts pulses of flowmeter 40 and detects a flow rate of diluted water sent from nozzle 5*b* while physical button 3*b* is being pressed.

Furthermore, control section 20 counts pulses of flowmeter 40, controls the number of revolutions of first syrup motor 26 based on the pulses and thereby controls a flow rate of the first syrup sent from nozzle 5*b* while physical button 3*b* is being pressed.

Control section 20 counts pulses of flowmeter 40, controls the number of revolutions of second syrup motor 29 based on the pulses, and thereby controls a flow rate of the second syrup sent from nozzle 5*b* while physical button 3*b* is being pressed.

Furthermore, control section 20 is provided with a timer that is activated simultaneously with the pressing of physical button 3*b* and measures an elapsed time from the time of pressing. Control section 20 performs, for example, the following control based on the elapsed time measured by the timer.

After prescribed time A (e.g., 0 to 0.7 seconds) passes from the start of driving of first syrup motor 26 (start of opening of first syrup solenoid valve 25 or second syrup solenoid valve 28), control section 20 controls second syrup motor 29 to start driving second syrup motor 29.

At this time, control section 20 intermittently drives second syrup motor 29. For example, as shown in FIG. 6A, second syrup motor 29 repeats a cycle of driving for prescribed time B (e.g., 0.1 to 0.3 seconds) and stopping for prescribed time C (0.7 to 0.9 seconds).

Driven by second syrup motor 29, second syrup pump 30 sends a small amount of undiluted topping syrup supplied from syrup tank 10*b* to nozzle 5*b* via second syrup solenoid valve 28 which is open. Second syrup pump 30 is, for example, a gear pump.

While physical button 3*b* is being pressed in this way, the aforementioned diluted water, main syrup and topping syrup are mixed together at nozzle 5*b* and discharged into a container placed at container placement area 4*b* as a carbonate-free, flavor-added beverage.

Note that as described above, beverage supplying apparatus 100 produces a main beverage by mixing the diluted water and the main syrup at a prescribed ratio and also produces a beverage by mixing an undiluted topping syrup with the main beverage, and control section 20 changes the above prescribed ratio when mixing the diluted water and the main syrup in accordance with a combination of the main syrup and the topping syrup.

This makes it possible to keep the sugar content or the like of beverage to be produced within a certain range irrespective of a combination of the main syrup and the topping syrup.

Note that the flow rate of diluted water may be detected from an opening time period (time during which the valve is open) of diluted water solenoid valve 32 instead of flowmeter 40. Furthermore, the flow rates of the first syrup and the second syrup may be detected by a flowmeter which is not shown (e.g., flowmeters provided downstream of first syrup solenoid valve 25 and downstream of second syrup solenoid valve 28 respectively).

Furthermore, a configuration may also be adopted in which control section 20 not only generates a pulse every time a unit amount of diluted water passes through flowmeter 40 but also counts this pulse and measures the time, and thereby controls first syrup motor 26, second syrup motor 29, diluted water solenoid valve 32, first syrup solenoid valve 25, second syrup solenoid valve 28 or the like based on the measured time.

After that, when a carbonate-free, flavor-added beverage is discharged into the container and pressing of physical button 3*b* ends, control section 20 closes first syrup solenoid valve 25 and second syrup solenoid valve 28 as shown in FIG. 6A.

Simultaneously, control section 20 stops driving of first syrup motor 26 and second syrup motor 29. In this way, discharging of the beverage from nozzle 5*b* is stopped.

Control section 20 opens carbonated water solenoid valve 22 for a prescribed time (e.g., 0.1 seconds) after pressing of physical button 3*b* ends. The reason that carbonated water solenoid valve 22 is opened for a prescribed time after pressing of physical button 3*b* ends is to clean nozzle 5*b* with carbonated water.

Simultaneously with the end of pressing of physical button 3*b*, control section 20 stops diluted water pump motor 33, closes diluted water solenoid valve 32 after a prescribed time (e.g., 0.2 seconds) passes from the end of pressing of physical button 3*b* and closes diluted water inlet solenoid valve 31 after a prescribed time (e.g., 0.5 seconds) passes from the end of pressing of physical button 3*b*. The reason that interlocking among diluted water pump motor 33, diluted water inlet solenoid valve 31, and diluted water solenoid valve 32 is controlled is to prevent the occurrence of water hammer.

As described above, according to beverage supplying apparatus 100 of the present embodiment, an undiluted topping syrup is intermittently discharged using the syrup pump, and it is thereby possible to control the discharge amount of the topping syrup with high accuracy and produce a beverage with a flavor as intended by the beverage manufacturer.

Next, a case will be described using FIG. 6A where after a beverage is supplied, an operation for further adding a beverage is performed. FIG. 6A shows a case where physical button 3*b* is pressed for time D as an addition operation and physical button 3*b* is then further pressed for time E.

As shown in FIG. 6A, for time D from start to end of pressing of physical button 3*b*, if an elapsed time after driving of first syrup motor 26 is started (or opening of first syrup solenoid valve 25 or second syrup solenoid valve 28 is started) is less than prescribed time A (e.g., 0 to 0.7 seconds), control section 20 does not drive second syrup motor 29. In this case, the topping syrup is not added to the addition target beverage.

On the other hand, for time E from start to end of pressing of physical button 3*b*, if an elapsed time after driving of first syrup motor 26 is started (or opening of first syrup solenoid valve 25 or second syrup solenoid valve 28 is started) is equal to or greater than prescribed time A (e.g., 0 to 0.7 seconds), control section 20 drives second syrup motor 29. In this case, the topping syrup is added to the addition target beverage.

When an addition operation is performed under such control, the topping syrup can be easily added.

(Method for Supplying Weak Carbonated, Flavor-Added Beverage)

Next, an example of control operation when a weak carbonated, flavor-added beverage is supplied will be described. When weak carbonated, flavor-added beverage is supplied, control section 20 can also control each solenoid valve 22, 25, 28, 31, 32 or 39 and each motor 26, 29 or 33 as in the case of control operation when the aforementioned strong carbonated or carbonate-free, flavor-added beverage is supplied.

Here, the weak carbonated, flavor-added beverage refers to a beverage in which the main syrup, diluted water (tap water), carbonated water and topping syrup are mixed together.

Figure 6B:
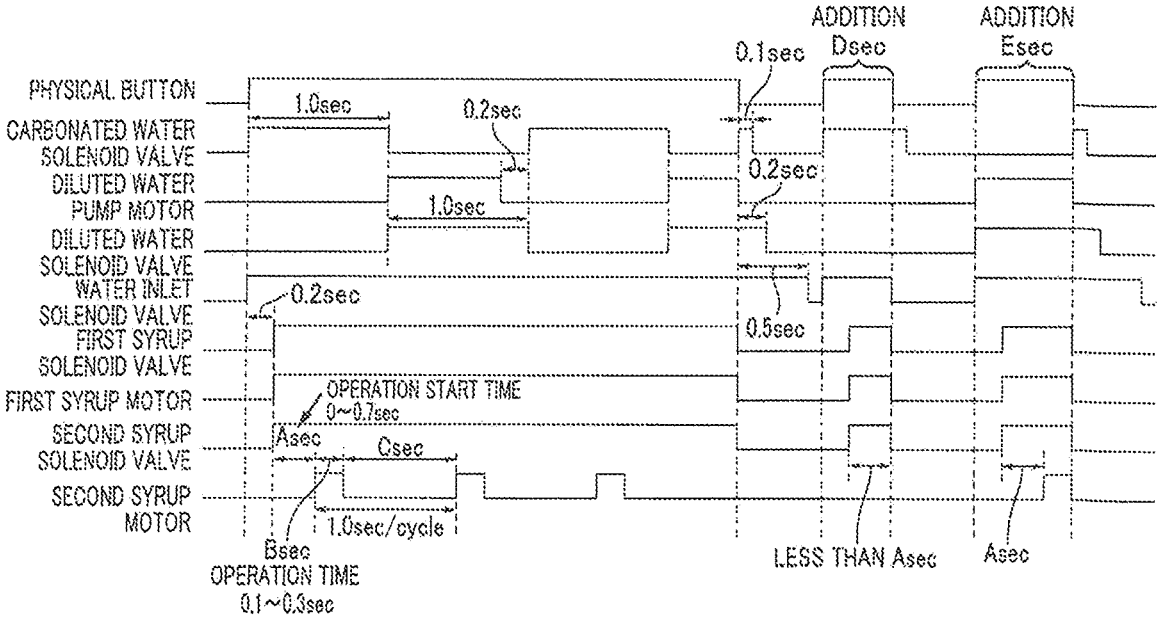
FIG. 6B is a time chart of the beverage supplying apparatus according to the embodiment of the present invention when a weak carbonated, flavor-added beverage is supplied.

FIG. 6B is a time chart when a weak carbonated, flavor-added beverage is supplied. In the case of FIG. 6B, unlike the case of FIG. 6A, when physical button 3*b* is pressed, diluted water inlet solenoid valve 31 is opened and carbonated water solenoid valve 22 is intermittently opened.

Here, control section 20 is provided with a timer that is activated simultaneously with pressing of physical button 3*b* and measures an elapsed time from the time of pressing. Control section 20 then performs, for example, the following control based on the elapsed time measured by the timer.

For example, control section 20 controls opening/closing of carbonated water solenoid valve 22 so as to repeat a cycle in which carbonated water solenoid valve 22 is opened for 1.0 second and closed for 1.0 second as shown in FIG. 6B. In this way, carbonated water is intermittently supplied to nozzle 5*b*.

Here, flowmeter 24 generates a pulse every time a unit amount of carbonated water passes. Flowmeter 40 generates a pulse every time a unit amount of diluted water passes. Control section 20 then performs, for example, the following control based on these pulses.

Control section 20 counts a pulse of flowmeter 24, and thereby detects the flow rate of carbonated water sent from nozzle 5*b* while physical button 3*b* is being pressed.

Furthermore, control section 20 counts pulses of flowmeter 40, and thereby detects the flow rate of diluted water sent from nozzle 5*b* while physical button 3*b* is being pressed.

Furthermore, control section 20 counts pulses of flowmeter 24 or flowmeter 40, controls the number of revolutions of first syrup motor 26 based on the pulses, and thereby controls the flow rate of the first syrup sent from nozzle 5*b* while physical button 3*b* is being pressed.

Control section 20 counts pulses generated by flowmeter 24 or flowmeter 40, controls the number of revolutions of second syrup motor 29 based on the pulses, and thereby controls the flow rate of the second syrup sent from nozzle 5*b* while physical button 3*b* is being pressed.

As shown in FIG. 6B, while carbonated water solenoid valve 22 is closed (e.g., for 1.0 second), control section 20 opens diluted water solenoid valve 32 and drives diluted water pump motor 33 for a prescribed period (e.g., for 0.8 seconds) after carbonated water solenoid valve 22 is closed. In this way, diluted water is intermittently supplied to nozzle 5*b*.

After prescribed time A (e.g., 0 to 0.7 seconds) passes from the start of the driving of first syrup motor 26 (start of opening of first syrup solenoid valve 25 or second syrup solenoid valve 28), control section 20 controls second syrup motor 29 to start driving second syrup motor 29.

At this time, control section 20 intermittently drives second syrup motor 29. For example, as shown in FIG. 6B, second syrup motor 29 repeats a cycle of driving for prescribed time B (e.g., 0.1 to 0.3 seconds) and stopping for prescribed time C (0.7 to 0.9 seconds).

Driven by second syrup motor 29, second syrup pump 30 sends a small amount of undiluted topping syrup supplied from syrup tank 10*b* to nozzle 5*b* via second solenoid valve 28 which is open. Second syrup pump 30 is, for example, a gear pump.

Thus, while physical button 3*b* is being pressed, the aforementioned carbonated water, diluted water, main syrup and topping syrup are mixed together at nozzle 5*b* and discharged into a container placed at container placement area 4*b* as a weak carbonated, flavor-added beverage.

Note that as described above, beverage supplying apparatus 100 produces a main beverage by mixing diluted water, carbonated water and main syrup at a prescribed ratio and produces a beverage by mixing an undiluted topping syrup with the main beverage, and control section 20 changes the above prescribed ratio when mixing diluted water, carbonated water and main syrup in accordance with the combination of the main syrup and the topping syrup.

This makes it possible to keep the sugar content or the like of the beverage to be produced irrespective of the combination of the main syrup and the topping syrup.

Note that the flow rate of carbonated water may be detected from the opening time (time period during which the valve is open) of carbonated water solenoid valve 22 instead of flowmeter 24. Furthermore, the flow rate of the diluted water may also be detected from the opening time (time period during which the valve is open) of diluted water solenoid valve 32 instead of flowmeter 40.

Furthermore, the flow rates of the first syrup and the second syrup may also be detected from a flowmeter which is not shown (e.g., flowmeter provided downstream of first syrup solenoid valve 25 or downstream of second syrup solenoid valve 28).

A configuration may also be adopted in which not only by generating a pulse every time a unit amount of carbonated water passes through flowmeter 24, but also by counting this pulse to thereby measure the time, control section 20 controls first syrup motor 26, second syrup motor 29, carbonated water solenoid valve 22, first syrup solenoid valve 25, second syrup solenoid valve 28 or the like based on the time.

A configuration may also be adopted in which not only by generating a pulse every time a unit amount of carbonated water passes through flowmeter 40, but also by counting this pulse to thereby measure the time, control section 20 controls first syrup motor 26, second syrup motor 29, diluted water solenoid valve 32, first syrup solenoid valve 25, second syrup solenoid valve 28 or the like based on the time.

After that, when a weak carbonated, flavor-added beverage is discharged into the container and the pressing of physical button 3*b* ends, control section 20 closes first syrup solenoid valve 25 and second syrup solenoid valve 28 as shown in FIG. 6B.

Simultaneously, control section 20 stops driving of first syrup motor 26 and second syrup motor 29. Discharging of the beverage from nozzle 5*b* is thereby stopped.

Control section 20 closes carbonated water solenoid valve 22 for a prescribed time (e.g., 0.1 seconds) from the end of pressing of physical button 3*b*. The reason that carbonated water solenoid valve 22 is opened after the end of the pressing of physical button 3*b* is to clean nozzle 5*b* with carbonated water.

Simultaneously with the end of pressing of physical button 3*b*, control section 20 stops diluted water pump motor 33, closes diluted water solenoid valve 32 after a prescribed time (e.g., 0.2 seconds) passes from the end of pressing of physical button 3*b* and closes diluted water inlet solenoid valve 31 after a prescribed time (e.g., 0.5 seconds) passes from the end of pressing of physical button 3*b*. The reason that interlocking among diluted water pump motor 33, diluted water inlet solenoid valve 31, and diluted water solenoid valve 32 is controlled is to prevent the occurrence of water hammer.

Next, a case will be described using FIG. 6B where after a beverage is supplied, an operation for further adding a beverage is performed. FIG. 6B shows a case where physical button 3*b* is pressed for time D as an addition operation and physical button 3*b* is then further pressed for time E.

As shown in FIG. 6B, for time D from start to end of pressing of physical button 3*b*, if an elapsed time after driving of first syrup motor 26 is started (or opening of first syrup solenoid valve 25 or second syrup solenoid valve 28 is started) is less than prescribed time A (e.g., 0 to 0.7 seconds), control section 20 does not drive second syrup motor 29. In this case, the topping syrup is not added to the addition target beverage.

On the other hand, for time E from start to end of pressing of physical button 3*b*, if an elapsed time after driving of first syrup motor 26 is started (or opening of first syrup solenoid valve 25 or second syrup solenoid valve 28 is started) is equal to or greater than prescribed time A (e.g., 0 to 0.7 seconds), control section 20 drives second syrup motor 29. In this case, the topping syrup is added to the addition target beverage.

When an addition operation is performed under such control, the topping syrup can be easily added.

The embodiment of the present invention has been described so far, but the present invention is not limited to the above embodiment, and can be modified in various ways. Hereinafter, such modifications will be described.

(Modification 1)

In the above embodiment, only discharging of a topping syrup is performed intermittently, but, in addition, discharging of a main syrup may also be performed intermittently. Hereinafter, such a case will be described using FIG. 7.

Figure 7:
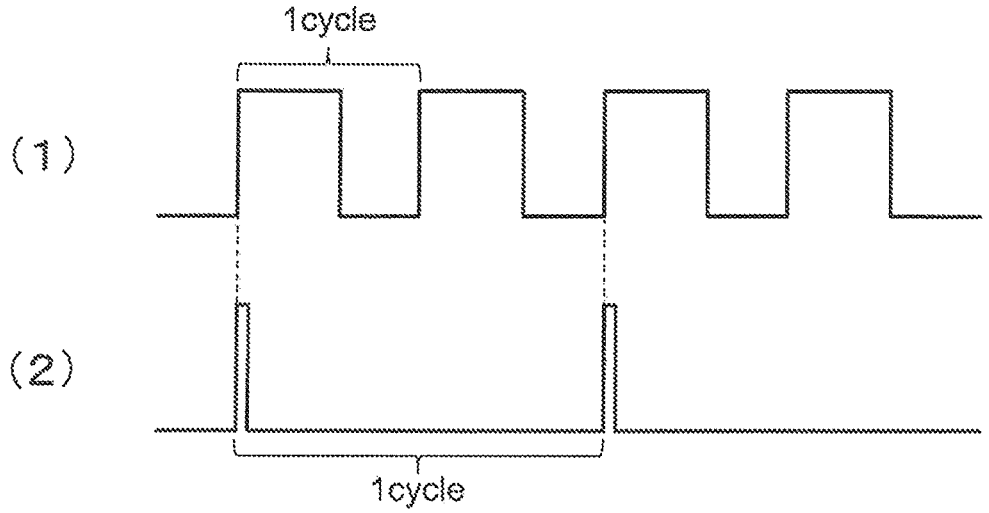
FIG. 7 is a diagram illustrating intermittent discharging of a main syrup with the beverage supplying apparatus according to modification 1 of the embodiment of the present invention.

FIG. 7 is a diagram illustrating intermittent discharging of the main syrup. (1) in FIG. 7 shows drive timing of first syrup motor 26 described in FIG. 5 and (2) in FIG. 7 shows drive timing of second syrup motor 29 described in FIG. 5.

As shown in FIG. 7, first syrup motor 26 may also be assumed to intermittently operate. The main syrup is thereby intermittently discharged into nozzle 5*b*.

In this case, second syrup motor 29 is driven in every other time zone among a plurality of time zones in which first syrup motor 26 is driven. This allows second syrup pump 30 to be driven with a smaller amount of discharge than the amount of discharge of first syrup pump 27. As a result, it is possible to accurately add a small amount of undiluted topping syrup by a prescribed amount.

Note that second syrup motor 29 is assumed to be driven in every other time zone but the present invention is not limited to this, and it is possible to drive second syrup motor 29 in conjunction with timing in every N time zones (N is an integer equal to or greater than 1) among the plurality of time zones in which first syrup motor 26 is driven.

Furthermore, in this case, the undiluted topping syrup is discharged at the same timing as the main syrup. It is thereby possible to further promote mixing of carbonated water, main syrup and topping syrup in nozzle 5*b*.

Furthermore, by reducing the drive interval of second syrup motor 29 to a certain degree, it is possible to easily obtain a beverage in which carbonated water, main syrup and topping syrup are uniformly mixed even when the user stops pressing of physical button 3*b* at any time.

Note that in FIG. 7, discharge start timing of the topping syrup is assumed to be the same as the discharge start timing of the main syrup, but these timings need not always be the same.

(Modification 2)

In modification 1 above, it is assumed that first syrup pump 27 and second syrup pump 30 achieve intermittent discharging of the main syrup and the topping syrup, but it is also possible to control discharging of the pressurized main syrup and topping syrup by opening/closing the solenoid valve and achieve intermittent discharging of the syrups.

In this case, instead of continuously discharging the topping syrup for a long period of time, the undiluted topping syrup is intermittently added, and it is therefore possible to precisely add a prescribed amount of topping syrup and prevent upsetting of flavor balance. As a result, the beverage manufacturer can provide to users, a beverage with an intended flavor.

Figure 8:
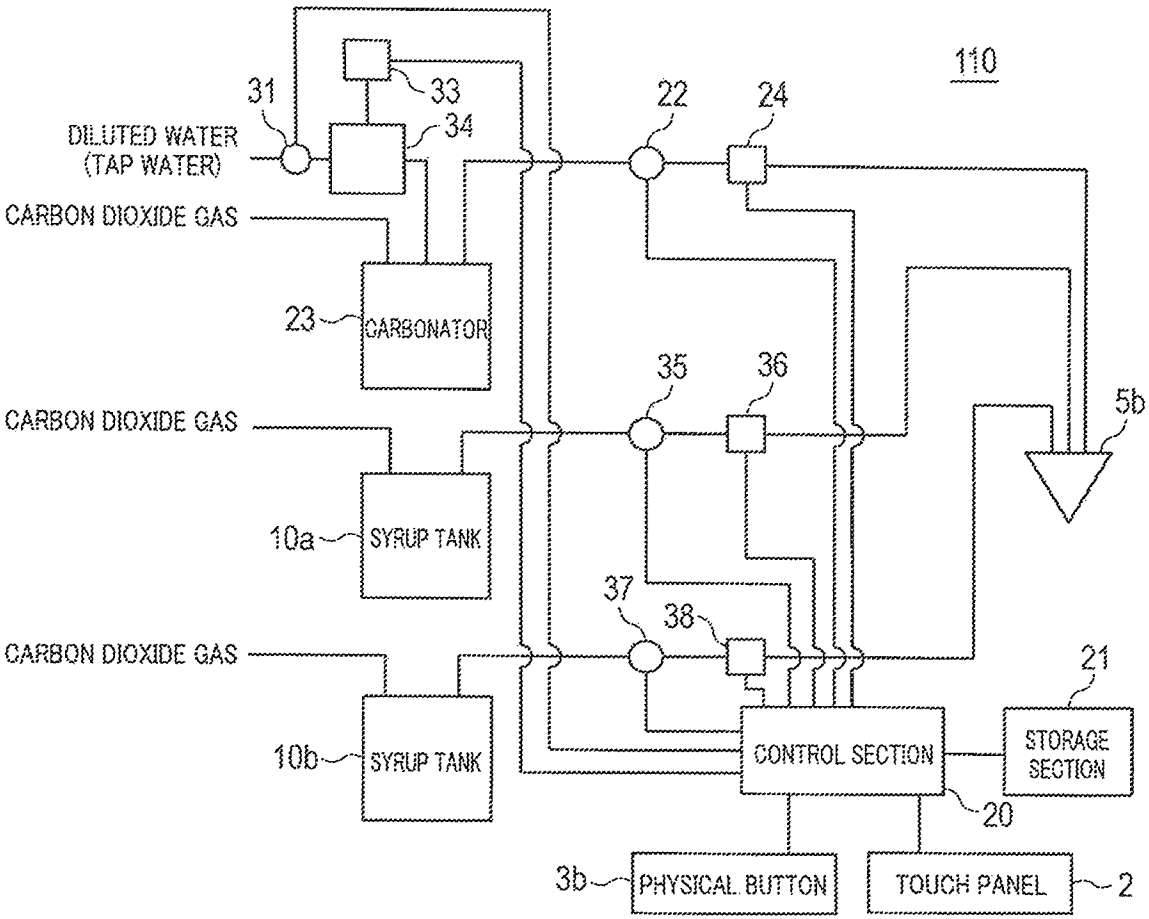
FIG. 8 is a diagram illustrating a piping system of a beverage supplying apparatus according to modification 2 of the embodiment of the present invention.

Hereinafter, control processing on a beverage supply by beverage supplying apparatus 110 according to the present modification will be described using FIG. 8. FIG. 8 is a diagram illustrating a piping system of beverage supplying apparatus 110 according to the present modification. Note that in FIG. 8, components identical to those in FIG. 4 are assigned identical reference numerals.

Note that an example will be described below where strong carbonated flavor-added beverage (beverage in which main syrup, carbonated water and topping syrup are mixed together) is supplied.

As shown in FIG. 8, beverage supplying apparatus 110 is provided with first syrup solenoid valve 35, first syrup flowmeter 36, second syrup solenoid valve 37 and second syrup flowmeter 38 in addition to aforementioned touch panel 2, physical button 3*b*, nozzle 5*b*, syrup tanks 10*a* and 10*b*, control section 20, storage section 21, carbonated water solenoid valve 22, carbonator 23, flowmeter 24, diluted water inlet solenoid valve 31, diluted water pump motor 33 and diluted water pump 34.

Syrup tank 10*a* and syrup tank 10*b* each correspond to one of syrup tanks 10 in FIG. 3 and store syrups (e.g., cola syrup, orange syrup) used as a main syrup or topping syrup.

Control section 20 is a control device such as a CPU (central processing unit). Storage section 21 is a memory device such as a ROM (read only memory) or RAM (random access memory).

When the user performs an operation for selecting a strong carbonated, flavor-added beverage on touch panel 2, control section 20 reads data relating to the selected beverage from storage section 21.

Examples of such data include data on a dilution ratio among a main syrup, carbonated water and topping syrup registered in association with combinations of the main syrup and topping syrup and setting data for controlling opening/closing of each solenoid valve (diluted water inlet solenoid valve 31, carbonated water solenoid valve 22, first syrup solenoid valve 35, second syrup solenoid valve 37).

When the user presses physical button 3*b*, control section 20 performs the following control based on each of the above pieces of data.

Figure 9:
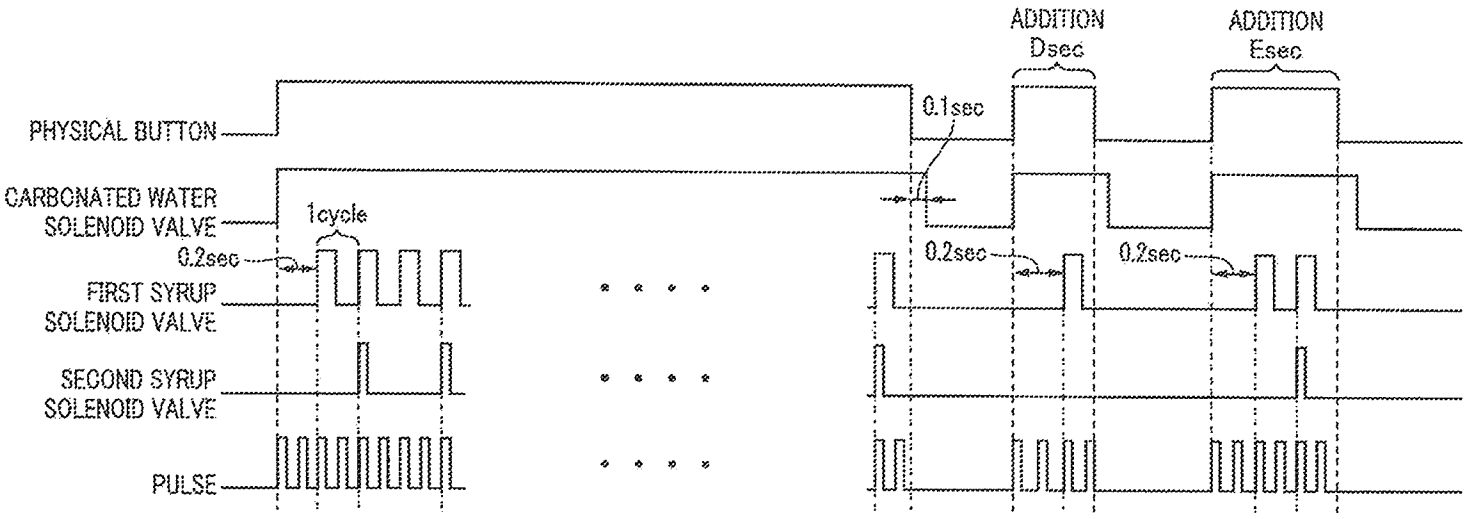
FIG. 9 is a time chart of the beverage supplying apparatus according to modification 2 of the embodiment of the present invention when strong carbonated beverage is supplied.

As shown in FIG. 9, when physical button 3*b* is pressed, control section 20 opens carbonated water solenoid valve 22 first. Carbonated water produced in carbonator 23 is sent to nozzle 5*b* via carbonated water solenoid valve 22 and flowmeter 24, which are open. Note that a method for manufacturing carbonated water is as described above, and therefore description thereof will be omitted here.

Here, flowmeter 24 generates a pulse every time a unit amount of carbonated water passes and control section 20 counts this pulse. Note that since the processing carried out by control section 20 based on the pulse is as described above, description thereof will be omitted here.

Control section 20 is provided with a timer that is activated simultaneously with the pressing of physical button 3*b* and measures an elapsed time from the time of pressing. Control section 20 performs, for example, the following control based on the elapsed time measured by the timer.

As shown in FIG. 9, after carbonated water solenoid valve 22 is opened, control section 20 controls opening/closing of first syrup solenoid valve 35 and second syrup solenoid valve 37.

More specifically, after a prescribed time (e.g., 0.2 seconds) passes from the opening of carbonated water solenoid valve 22, control section 20 intermittently opens first syrup solenoid valve 35 to discharge a main syrup.

For example, as shown in FIG. 9, first syrup solenoid valve 35 repeats a cycle of being open for a prescribed time and being closed for a prescribed time. The amount of the main syrup supplied can be variably adjusted based on an opening time of first syrup solenoid valve 35. Note that the amount of the main syrup supplied can also be adjusted by making the opening time constant and making the cycle variable.

Control section 20 also intermittently opens second syrup solenoid valve 37 to discharge a topping syrup. For example, second syrup solenoid valve 37 is opened in every other time zone among a plurality of time zones in which first syrup solenoid valve 35 is opened.

This makes it possible to discharge the topping syrup with a discharge amount smaller than the discharge amount of the main syrup. As a result, it is possible to precisely add a small amount of undiluted topping syrup by a prescribed amount.

Note that it is assumed here that second syrup solenoid valve 37 is opened in every other time zone, but the present invention is not limited to this. For example, second syrup solenoid valve 37 may be opened in conjunction with timing of every N (N is an integer equal to or greater than 1) time zones among a plurality of time zones in which first syrup solenoid valve 35 is opened.

In this way, while physical button 3*b* is being pressed, the aforementioned carbonated water, main syrup and topping syrup are mixed together at nozzle 5*b* and is discharged into a container placed at container placement area 4*b* as a strong carbonated, flavor-added beverage.

Note that as described above, beverage supplying apparatus 110 produces a main beverage by mixing the carbonated water and main syrup at a prescribed ratio and produces a beverage by mixing an undiluted topping syrup with the main beverage, but control section 20 changes the above prescribed ratio when mixing the carbonated water and main syrup in accordance with the combination of the main syrup and topping syrup.

It is thereby possible to keep the sugar content or the like of the beverage to be produced within a certain range irrespective of the combination of the main syrup and topping syrup.

Note that while physical button 3*b* is being pressed, control section 20 can detect the mixing ratio of beverage being produced at any appropriate time from the detected flow rate of flowmeter 24, first syrup flowmeter 36 and second syrup flowmeter 38.

A configuration may also be adopted in which not only by generating a pulse every time a unit amount of carbonated water passes through flowmeter 24 but also by counting this pulse to thereby measure the time, control section 20 controls diluted water inlet solenoid valve 31, diluted water pump motor 33, carbonated water solenoid valve 22, first syrup solenoid valve 35, second syrup solenoid valve 37 or the like based on the time.

Although the present modification adopts a configuration in which control section 20 counts pulses generated by flowmeter 24, it is also possible to count pulses generated every time a unit amount of syrup passes through, for example, any one of first syrup flowmeter 36 and second syrup flowmeter 38.

After that, when a strong carbonated, flavor-added beverage is discharged into the container and pressing of physical button 3*b* ends, control section 20 closes first syrup solenoid valve 35 and second syrup solenoid valve 37 as shown in FIG. 9. Discharging of the beverage from nozzle 5*b* is thus stopped.

After a prescribed time (e.g., 0.1 seconds) passes from the end of pressing of physical button 3*b*, control section 20 closes carbonated water solenoid valve 22. The reason that carbonated water solenoid valve 22 is not closed immediately after the end of pressing of physical button 3*b* is to clean nozzle 5*b* with carbonated water.

As described above, beverage supplying apparatus 110 according to the present modification intermittently discharges an undiluted topping syrup using the solenoid valve, and can thereby control the amount of topping syrup discharged with high accuracy and produce beverage with a flavor as intended by the beverage manufacturer.

Next, a case will be described using FIG. 9 where after a beverage is supplied, a beverage addition operation is further performed. FIG. 9 illustrates a case where as an addition operation, physical button 3*b* is pressed for time D and then physical button 3*b* is further pressed for time E.

As shown in FIG. 9, if the number of time zones in which first syrup solenoid valve 35 is open is less than two for time D from start to end of pressing of physical button 3*b*, control section 20 keeps second syrup solenoid valve 37 closed. In this case, the topping syrup is not added to addition target beverage.

On the other hand, as shown in FIG. 9, if the number of time zones in which first syrup solenoid valve 35 is open is two for time E from start to end of pressing of physical button 3*b*, control section 20 opens second syrup solenoid valve 37 in the second time zone in which first syrup solenoid valve 35 is open. In this case, the topping syrup is added to the addition target beverage.

When an addition operation is performed under such control, the topping syrup can be easily added.

Note that if an addition operation in which the number of time zones during which first syrup solenoid valve 35 is open is less than two is repeatedly performed, the ratio of the topping syrup to the beverage decreases. Therefore, control section 20 may perform the following control.

More specifically, when physical button 3*b* is pressed a plurality of times, if the total number of time zones in which first syrup solenoid valve 35 is closed each time is two or more, control section 20 may open second syrup solenoid valve 37 in every other time zone among those time zones.

Even when an addition operation is repeatedly performed for which the number of time zones in which first syrup solenoid valve 35 is open is less than two, a topping syrup is added and a beverage with a more optimum flavor can be supplied to the user.

The modifications of the embodiment of the present invention have been described so far, but the aforementioned modifications may be implemented in any combination.

The disclosure of Japanese Patent Application No. 2014-223608, filed on Oct. 31, 2014, including the specification, drawings and abstract is incorporated herein by reference in its entirety.

INDUSTRIAL APPLICABILITY

The present invention is useful for a beverage supplying apparatus that supplies a beverage.

REFERENCE SIGNS LIST

1 Front door
2 Touch panel
3*a*, 3*b*, 3*c* Physical button
4*a*, 4*b*, 4*c* Container placement area
5*a*, 5*c* Diluted water nozzle
5*b* nozzle
6, 7 Bag-in-box
8 Cleaning filter
9 Carbon dioxide gas cylinder
10, 10*a*, 10*b* Syrup tank
11, 12, 14, 15, 16 Blade tube
13 Gas regulator
17, 18 BIB tube pump
20 Control section
21 Storage section
22 Carbonated water solenoid valve
23 Carbonator
24, 40 Flowmeter
25, 35 First syrup solenoid valve
26 First syrup motor
27 First syrup pump
28, 37 Second syrup solenoid valve
29 Second syrup motor
30 Second syrup pump
31 Diluted water inlet solenoid valve
32 Diluted water solenoid valve
33 Diluted water pump motor
34 Diluted water pump
36 First syrup flowmeter
38 Second syrup flowmeter
39 Pressurized water solenoid valve
50, 51 Syrup nozzle
52 Carbonated water nozzle
100, 110 Beverage supplying apparatus

The invention claimed is:

1. A beverage supplying apparatus comprising:

an operation receiver that receives an operation for selecting whether to use a syrup stored in a syrup tank to be provided in the beverage supplying apparatus as a main syrup or a topping syrup; and a mixer that, when the syrup is selected as the main syrup, produces a main beverage by mixing the main syrup with water or carbonated water and that, when the syrup is selected as the topping syrup, produces a beverage by mixing the topping syrup with the main beverage.

2. The beverage supplying apparatus according to claim 1, wherein the mixer intermittently supplies the topping syrup to the main beverage.

3. The beverage supplying apparatus according to claim 1, wherein the mixer continuously supplies the topping syrup for a predetermined time period.

4. The beverage supplying apparatus according to claim 1, wherein the mixer repeatedly performs a plurality of times, for a time period during which the main syrup is supplied, one cycle comprising a time period during which the topping syrup is supplied and a time period during which the topping syrup is not supplied.

5. The beverage supplying apparatus according to claim 1, wherein when the syrup is selected as the main syrup, the mixer produces the main beverage by diluting the main syrup with water or carbonated water and intermittently supplies another syrup selected as the topping syrup without diluting the another syrup to the main beverage and produces the beverage by mixing the topping syrup with the main beverage.

6. The beverage supplying apparatus according to claim 1, wherein when the syrup is selected as the topping syrup, the mixer produces the main beverage by diluting another syrup selected as the main syrup with water or carbonated water and intermittently supplies the topping syrup without diluting the topping syrup to the main beverage and produces the beverage by mixing the topping syrup with the main beverage.

* * * * *